US008011564B2

(12) United States Patent
Garner

(10) Patent No.: US 8,011,564 B2
(45) Date of Patent: Sep. 6, 2011

(54) EASY OPENING CARTON HAVING IMPROVED STACKING STRENGTH

(75) Inventor: Chester Garner, Richmond, IN (US)

(73) Assignee: Georgia-Pacific Corrugated LLC, Atlanta, GA (US)

( * ) Notice: Subject to any disclaimer, the term of this patent is extended or adjusted under 35 U.S.C. 154(b) by 270 days.

(21) Appl. No.: 12/248,060

(22) Filed: Oct. 9, 2008

(65) Prior Publication Data

US 2009/0095799 A1 Apr. 16, 2009

Related U.S. Application Data

(60) Provisional application No. 60/979,252, filed on Oct. 11, 2007.

(51) Int. Cl.
*B65D 17/28* (2006.01)

(52) U.S. Cl. ..... 229/110; 229/241; 229/242

(58) Field of Classification Search ..... 229/109, 229/110, 240, 241, 242, 112, 137
See application file for complete search history.

(56) References Cited

U.S. PATENT DOCUMENTS

| | | | | |
|---|---|---|---|---|
| 272,327 | A | | 2/1883 | Rogers |
| 981,993 | A | | 1/1911 | Gair et al. |
| 1,892,594 | A | | 12/1932 | Stone |
| 2,082,365 | A | | 6/1937 | Straw et al. |
| 2,114,052 | A | | 4/1938 | Kincade, Jr |
| 2,300,492 | A | | 11/1942 | Fischer |
| 2,346,488 | A | * | 4/1944 | Hoffmaster et al. ..... 229/242 |
| 2,367,717 | A | | 1/1945 | Davidson |
| 2,547,892 | A | * | 4/1951 | Stevens ..... 229/242 |
| 2,857,090 | A | | 10/1958 | Fallert |
| 2,887,389 | A | | 5/1959 | Linville |
| 2,962,202 | A | | 11/1960 | Hansen |
| 3,164,316 | A | | 1/1965 | Wurster et al. |
| 3,202,339 | A | | 8/1965 | Franklin, Jr. |
| 3,206,099 | A | | 9/1965 | Fanter et al. |
| 3,217,924 | A | | 11/1965 | Chidsey, Jr. |
| 3,265,285 | A | | 8/1966 | Fanter |
| 3,309,005 | A | * | 3/1967 | Pilger ..... 229/241 |
| 3,353,740 | A | | 11/1967 | Outwater |
| 3,447,735 | A | | 6/1969 | Whitney |
| 3,552,633 | A | | 1/1971 | Ketler |
| 3,688,972 | A | | 9/1972 | Mahon |
| 3,698,548 | A | | 10/1972 | Stenzel et al. |
| 3,747,801 | A | * | 7/1973 | Graser ..... 229/240 |

(Continued)

FOREIGN PATENT DOCUMENTS

DE 1281342 B 10/1968

(Continued)

OTHER PUBLICATIONS

International Search Report and Written Opinion of the International Searching Authority of PCT/US2008/079278, dated Feb. 5, 2009.

*Primary Examiner* — Gary E Elkins
(74) *Attorney, Agent, or Firm* — William W. Letson

(57) ABSTRACT

A carton having a dispensing opening. The carton can be formed from a paperboard blank so it has six corners and two corner panels and has perforations formed therein to provide an easy opening feature for dispensing product. In addition, the formed carton has improved stacking strength.

20 Claims, 4 Drawing Sheets

U.S. PATENT DOCUMENTS

| | | | | | |
|---|---|---|---|---|---|
| 3,826,421 | A | * | 7/1974 | Morse et al. | 229/123.1 |
| 3,883,067 | A | | 5/1975 | McGlynn et al. | |
| 4,029,207 | A | | 6/1977 | Gordon | |
| 4,056,223 | A | | 11/1977 | Williams | |
| 4,084,693 | A | | 4/1978 | Culpepper | |
| 4,256,226 | A | | 3/1981 | Stone | |
| 4,267,959 | A | | 5/1981 | Gilbert | |
| 4,283,001 | A | | 8/1981 | Meyers | |
| 4,702,407 | A | * | 10/1987 | Lisiecki | 229/137 |
| 4,771,939 | A | | 9/1988 | Wilkins | |
| 4,850,527 | A | | 7/1989 | Church et al. | |
| 5,147,271 | A | | 9/1992 | Bacques et al. | |
| 5,160,307 | A | | 11/1992 | Bacques et al. | |
| D337,270 | S | | 7/1993 | Brockman | |
| 5,295,623 | A | | 3/1994 | Bacques et al. | |
| 5,323,957 | A | | 6/1994 | Roosa | |
| 5,375,715 | A | | 12/1994 | Serre et al. | |
| 5,381,948 | A | | 1/1995 | Coalier et al. | |
| 5,395,043 | A | | 3/1995 | Bacques et al. | |
| 5,400,955 | A | | 3/1995 | Coalier et al. | |
| 5,427,242 | A | | 6/1995 | Oliff et al. | |
| 5,474,232 | A | * | 12/1995 | Ljungstrom et al. | 229/137 |
| 5,752,648 | A | | 5/1998 | Quaintance | |
| 5,755,377 | A | | 5/1998 | Durand | |
| 5,878,946 | A | | 3/1999 | Frerot et al. | |
| 5,957,294 | A | * | 9/1999 | Kanter | 229/241 |
| 6,098,874 | A | * | 8/2000 | Tokarski | 229/235 |
| 6,257,411 | B1 | | 7/2001 | Bacques et al. | |
| 6,264,034 | B1 | | 7/2001 | Bacques et al. | |
| 6,598,785 | B2 | | 7/2003 | Berg et al. | |
| 6,749,107 | B2 | | 6/2004 | Quaintance | |
| 6,834,793 | B2 | | 12/2004 | Sutherland | |
| 6,866,186 | B2 | | 3/2005 | Fogle et al. | |
| 7,201,714 | B2 | | 4/2007 | Zoeckler et al. | |
| 7,766,219 | B2 | * | 8/2010 | Gomes et al. | 206/427 |
| 7,922,069 | B2 | | 4/2011 | Gardner | |
| 2003/0234285 | A1 | | 12/2003 | Bates et al. | |
| 2005/0189405 | A1 | | 9/2005 | Gomes et al. | |
| 2007/0000986 | A1 | | 1/2007 | McClure | |
| 2007/0063005 | A1 | | 3/2007 | Gomes et al. | |
| 2009/0121003 | A1 | | 5/2009 | Garner | |
| 2009/0121006 | A1 | | 5/2009 | Gasior | |
| 2009/0266874 | A1 | | 10/2009 | Smith | |
| 2011/0053746 | A1 | | 3/2011 | Desertot et al. | |
| 2011/0111938 | A1 | | 5/2011 | Smith | |

FOREIGN PATENT DOCUMENTS

| | | | |
|---|---|---|---|
| EP | 0468860 | A1 | 1/1992 |
| GB | 2419345 | A | 4/2006 |
| GB | 2436830 | A | 10/2007 |
| WO | 01/66423 | A1 | 9/2001 |
| WO | 2006/026767 | A2 | 3/2006 |

* cited by examiner

EASY OPENING CARTON HAVING IMPROVED STACKING STRENGTH

This application claims the benefit of U.S. Provisional Application No. 60/979,252 filed Oct. 11, 2007.

BACKGROUND OF THE INVENTION

The invention relates to packaging for shipping, storing and dispensing products. More particularly, the invention relates to a paperboard carton that can be used to package, ship, store and dispense a variety of products, such as consumer products and, more particularly, beverage containers. Such beverage containers may come in various configurations such as cylindrical cans, bottles of various configurations or flexible pouches having a substantially trapezoidal configuration.

For many years, beverage companies, such as soft drink, fruit juice and beer companies have packaged their products in light weight paperboard cartons and shipped such products to a retail outlet or some other location where consumers can purchase the products. There are many different types of cartons that can be used for packaging and shipping products from the manufacturer to the retailer. However, many of these cartons tend to be large and are designed to hold large numbers of products. Such cartons are suitable for "warehouse" type operations but are difficult for the consumer to use when the consumer needs smaller quantities for typical household activities.

Products can be packaged in smaller cartons containing quantities of product that a consumer would typically want to purchase for use in a relatively short period of time, such as ten or a dozen individual items. It is desirable for these smaller quantities of product to be packaged in smaller cartons that can be displayed for sale to the consumer at a typical retail outlet. In order to maximize the use of valuable floor space at the retail outlet, such smaller cartons may be stacked on top of each other to minimize the footprint left by the cartons and to provide an attractive display to entice the consumer to buy the product. Unfortunately, such stacking can result in damage to the carton causing the consumer to assume that the individual products packaged within the carton are damaged as well. This is bad for the retailer because such perceived damaged goods are more difficult to sell and thus can result in lower profits.

Another attribute that is desirable for such paperboard cartons is to ensure that the cartons are easily opened. This facilitates easy access by the consumer to the products, such as beverage containers, located therein. These paperboard cartons with easy opening features appeal to consumers because such cartons provide an easy way for the consumer to transport a number of products, such as beverage containers, therein from the retail outlet to the consumer's home. Moreover, the dispensing openings allow the paperboard cartons to also be stored in an easily accessible location in the consumer's home, such as the refrigerator, to allow neat storage of the product therein while providing easy access to the product one at a time.

Although some paperboard cartons having dispensing openings therein are currently available and generally work for their intended purposes they could be improved. For example, some of these cartons are in fact difficult to open. In addition, some of the cartons having such dispensing openings can have compromised structural integrity because of such openings. This problem can be exacerbated where cold beverage containers are packaged in the cartons in a warm and humid environment. This may result in condensation forming on the beverage containers. The moisture will have a deleterious effect on the paperboard carton.

Therefore, there is still a need to provide an easy opening paperboard carton with improved stacking strength that may be used to package and ship individual items from the manufacturer to a retail outlet and that can also be used in homes and other consumer locations.

BRIEF SUMMARY OF THE INVENTION

A paperboard carton is provided having a top, a bottom, two side walls and two multi-sided end walls. The multi-sided end walls provide two extra corners, for a total of six corners, and corner panels for the carton, thus increasing the stacking strength for the carton, as well as providing two extra display surfaces for the carton. Perforations formed in the carton are provided to allow a consumer or other user to form a dispenser opening in one end and corner of the carton by removing the material of the carton bounded by the perforations. The material used to form the paperboard carton can be any standard paperboard material such as corrugated paperboard that is typically used for packaging or shipping containers. This material provides enough rigidity to the carton to allow it to maintain its shape and retain the product therein until the product is to be dispensed therefrom.

A blank for forming the paperboard carton is also provided. The blank includes an adhesive panel, a first side panel, a bottom panel, a second side panel and a top panel. The top and bottom panels are mirror images of each other and each has an upper and lower end that is multi-sided. In addition, the sides of the top and bottom panels have different lengths. The shorter side panel includes corner panels adjoining the top and bottom thereof. Adjoining the top and bottom of the first side panel, the top and bottom panels and the corner panels are first and second end flaps, which overlap each other when the blank is folded to form the ends of the paperboard carton. Perforations are formed in the blank to form the dispensing opening when the blank is formed into the paperboard carton.

BRIEF DESCRIPTION OF THE DRAWINGS

The various objects, advantages and novel features of the present invention will be best understood by reference to the detailed description of the preferred embodiments which follows, when read in conjunction with the accompanying drawings, in which.

DETAILED DESCRIPTION OF THE INVENTION

Figure 1:
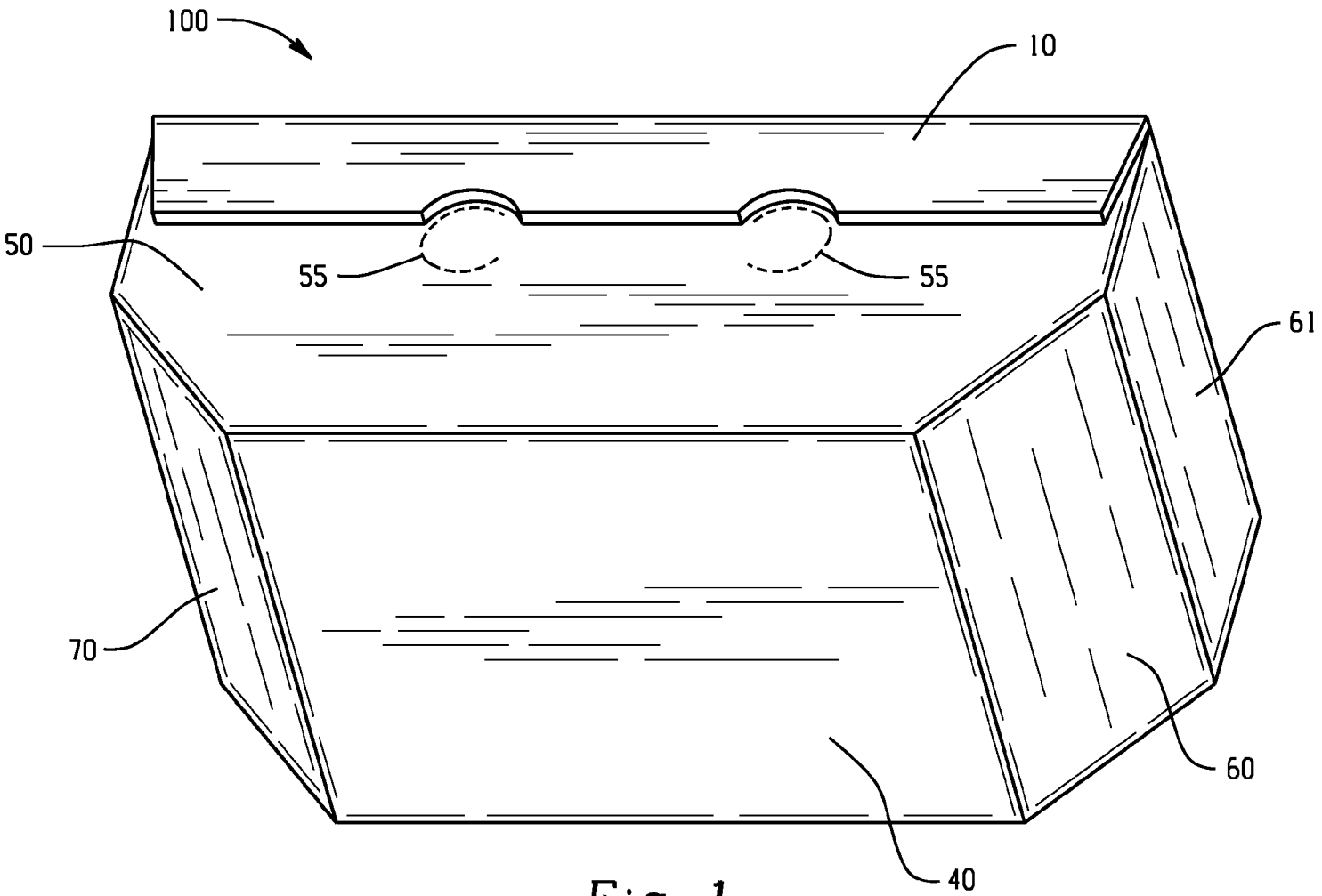
FIG. 1 is a top perspective view of one embodiment of the paperboard carton of the present invention.

In the drawings, the same elements are denoted by the same reference numerals even though they are depicted in different drawings. As used herein, the term "top" refers to a location on the carton and blank of this invention along the upper surface thereof as seen in the orientation shown in the Figs. As used herein, the term "bottom" refers to a location on the carton and blank of this invention along the lower surface as seen in the orientation shown in the Figs. As used herein, the term "end" when used in reference to a position on the carton of this invention refers to either the right most or left most side of the carton as seen in the orientation of the carton shown in FIGS. 1 and 2. As used herein, the term "right" refers to a location on the carton and blank of this invention along the right side as seen in the orientation shown in the Figs. As used herein, the term "left" refers to a location on the carton and blank of this invention along the left side as seen in the orientation shown in the Figs. As used herein, the term "upper" refers to a location on the carton and blank of this invention along the upper or top portion as seen in the orientation shown in the Figs. As used herein, the term "lower" refers to a location on the carton and blank of this invention along the lower or bottom portion as seen in the orientation shown in the Figs.

One of the advantages of the carton 100 of this invention is its ability to act as both a packaging structure and a dispenser for product located therein. Such product can include various types of beverage containers, whether these containers are flexible pouches, cans or bottles. Carton 100 includes perforations 25 and 45 (see FIG. 4), which are used to form end panel dispenser opening 110 therein. Preferably, perforation 25 is formed in an end portion of first side panel 20 and has an arcuate shape, although any other suitable shape could be used. In addition, perforation 45 is formed along an upper edge of second side panel 40 adjoining first corner panel 60 such that perforations 25 and 45 are along the same end of carton 100. These perforations 25 and 45 allow carton 100 to be transformed from merely a packaging structure, see FIG. 1, into a storage and dispensing unit, see FIG. 2. Thus carton 100 can be located on the shelf or the floor of a retail outlet for use as a modular display holding the beverage containers therein. Corner panels 60 and 70 and first corner panel top flap 61 and second corner panel bottom flap 72 also present additional display surfaces that increase the available printed exterior surface of carton 100 when it is used as a modular display. Carton 100 can also be stored at a consumer's home or office for subsequent use. The beverage containers, or other product located in carton 100 can be dispensed from dispenser opening 110 formed at an end of carton 100. Of course, if desired, two such dispenser openings could be located in carton 100, with one on each end thereof.

Figure 2:
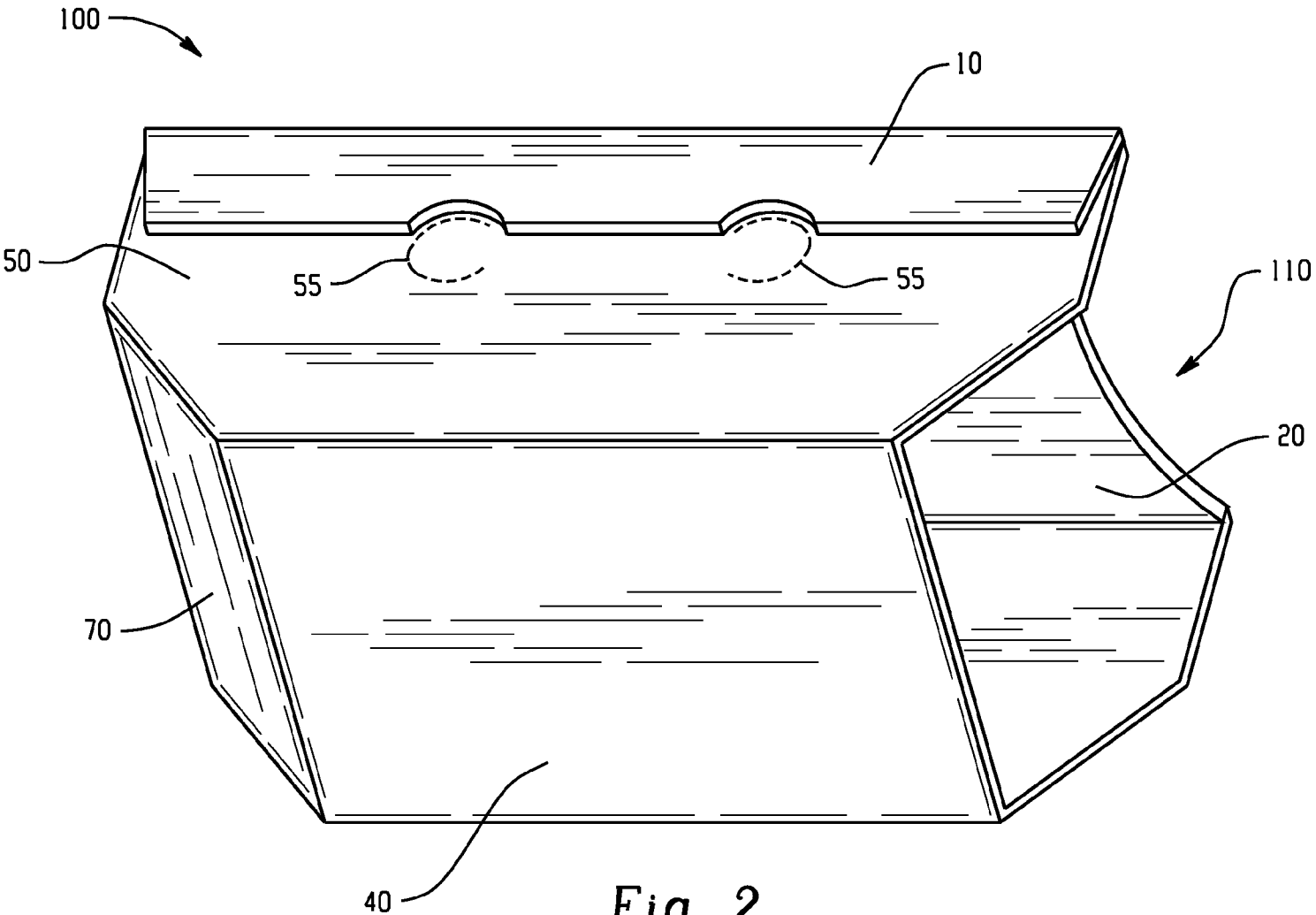
FIG. 2 is a top perspective view of the paperboard carton of the present invention as shown in FIG. 1 but with the right end and corner portions of the paperboard carton removed to provide a dispensing opening therein.
Figure 3:
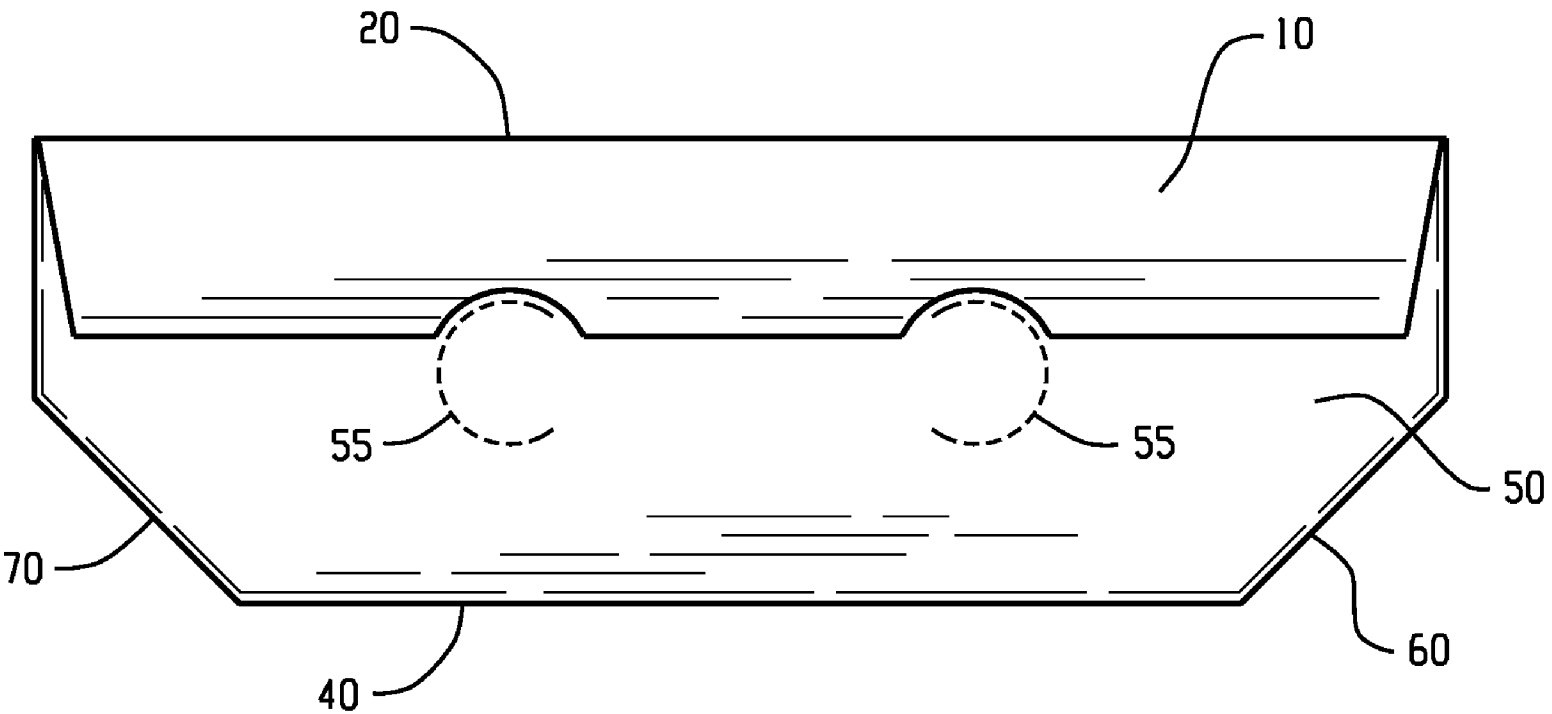
FIG. 3 is a top plan view of the paperboard carton of the present invention.
Figure 4:
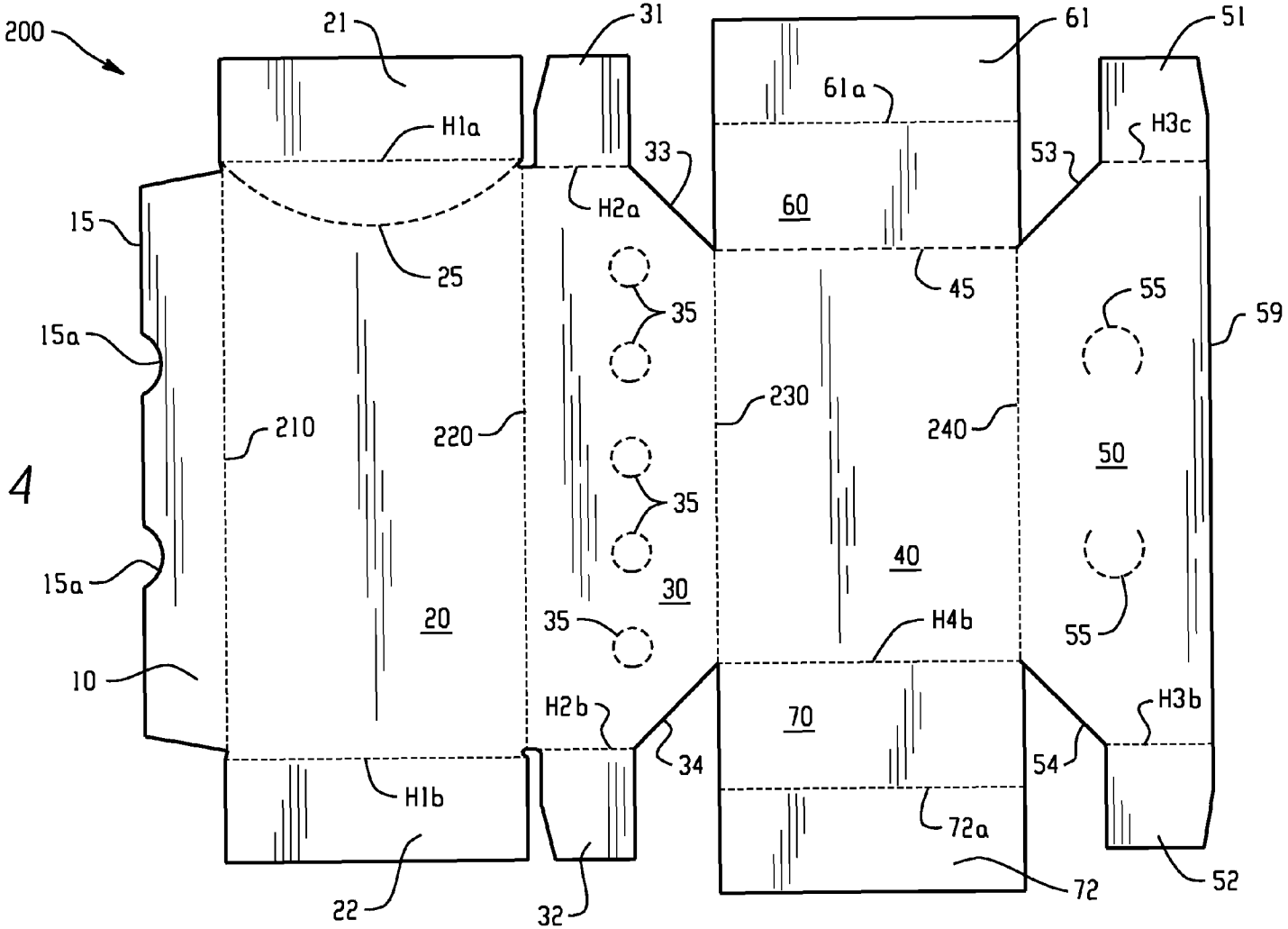
FIG. 4 is a plan view of the blank used to make the paperboard carton of the present invention.

Side panels 20 and 40 have a generally rectangular shape although side panel 20 has a larger cross sectional area than side panel 40. More particularly, first side panel 20 is wider (as seen in FIGS. 1-3) than second side panel 40. This configuration is used so that the ends of carton 100 are multi-sided to include corner panels 60 and 70. See FIG. 3. Preferably, the right end of carton 100 is formed by first corner panel 60 and first corner panel top flap 61, while the other end of carton 100 is formed by second corner panel 70 and second corner panel bottom flap 72. First corner side panel 60 and first corner panel top flap 61 are separated by a horizontal fold line 61*a*. Similarly, second corner panel 70 and second corner panel bottom flap 72 are separated by a horizontal fold line 72*a*. Because first side panel 20 has a larger cross sectional area, and specifically is wider than second side panel 40, the top edge of bottom panel 30 and the top edge of top panel 50 (as seen in FIG. 4) adjoin second side panel 40 by inclined edges 33 and 53 respectively along which first corner panel 60 adjoins bottom panel 30 and top panel 50. Similarly, the bottom edge of bottom panel 30 and the bottom edge of bottom panel 50 adjoin second side panel 40 by inclined edges 34 and 54 respectively along which second corner panel 70 adjoins bottom panel 30 and top panel 50. This configuration increases the structural integrity of carton 100 by giving it added stacking strength. The angle of inclined edges 33, 34, 53 and 54 can be any magnitude desired. The only requirements are that there be such an inclined edge and that the length of inclined edges 33, 34, 53 and 54 not be excessively long or short, which could result in a carton with corner panels having diminished aesthetics and functionality.

Openings may be formed in bottom panel 30. These openings could be cut into the blank 200 used to form carton 100 or they could be in the form of perforations 35 that could be torn open by the retailer or consumer. See FIG. 4. These openings are used to allow any moisture that condenses on the beverage containers to easily escape from carton 100. This will help prevent unnecessary moisture from pooling in carton 100 and thus help carton 100 maintain its strength. Any number of openings may be used, although applicant has found that five such evenly spaced openings work well. In addition, openings can be formed in top panel 50. Again, these openings 50 can be cut into blank 200 that is used to form carton 100 or they could be in the form of perforations 55 that could be torn away by the retailer or consumer. Preferably two such openings 55 are used to facilitate the transport of carton 100 by the consumer.

A paperboard blank 200 that can be used to make carton 100 is shown in FIG. 4. Blank 200 includes an adhesive tab 10. In addition, blank 200 includes four main panels, a first side panel 20, a bottom panel 30, a second side panel 40 and a top panel 50. Adhesive tab 10 is connected along its right side to the left side of first side panel 20 along a first vertical fold line 210. First side panel 20 is connected along its right side to the left side of bottom panel 30 along a second vertical fold line 220. Bottom panel 30 is connected along its right side to the left side of second side panel 40 along a third vertical fold line 230. Second side panel 40 is connected along its right side to the left side of top panel 50 along a fourth vertical fold line 240. First side panel 20 and second side panel 40 each has a generally rectangular cross section. The cross sectional area of first side panel 20 is greater than the cross sectional area of second side panel 40. Specifically, the lengths of first vertical fold line 210 and second vertical fold line 220 are greater than the lengths of third vertical fold line 230 and fourth vertical fold line 240. Bottom panel 30 and top panel 50 are mirror images of each other and each has a multi sided top and bottom. The top of bottom panel 30 is defined by a generally horizontal fold line H2*a* and inclined edge 33. The top of top panel 50 is defined by a generally horizontal fold line H3*c* and inclined edge 53. Similarly, the bottom of bottom panel 30 is defined by a generally horizontal fold line H2*b* and inclined edge 34. And, the bottom of top panel 50 is defined by a generally horizontal fold line H3*b* and inclined edge 54.

A first side panel top flap 21 extends above first side panel 20 above a generally horizontal fold line H1*a*. A first side panel bottom flap 22 extends below first side panel 20 below a generally horizontal fold line H1*b*. A bottom panel top flap 31 extends above bottom panel 30 above perforation line H2*a*. A bottom panel bottom flap 32 extends below bottom panel 30 below fold line H2*b*. First corner panel top flap 61 extends above first corner panel 60 above fold line 61*a*. First corner panel 60 extends above second side panel 40 above perforation 45. Second corner panel 70 extends below second side panel 40 below horizontal fold line H4*b*. Second corner panel bottom flap 72 extends below second corner panel 70 below generally horizontal fold line 72*a*. A top panel top flap 51 extends above top panel 50 above generally horizontal perforation line H3*c*. A top panel bottom flap 52 extends below top panel 50 below generally horizontal fold line H3*b*.

Perforation 25 is formed in the upper portion of side panel 20 and extends from first vertical fold line 210 to second vertical fold line 220 as shown in FIG. 4. Preferably perforation 25 has an arcuate shape, although other shapes for perforation 25 could be used as well. A horizontally extending perforation 45 defines the boundary between second side panel 40 and first corner panel 60. As described in more detail below, perforations 25 and 45 allow one end of carton 100 to be tom from the rest of carton 100 to form an opening 110. This provides easy access to the beverage containers stored in carton 100.

All perforations in paperboard blank 200 preferably are formed by scoring the paperboard so it is cut about 50% into the outer side of the paperboard material. This 50% cut is a continuous cut that extends from the surface of the material down to a depth that is half of the thickness of the material. The 50% cut assures a clean tear at the surface that leaves a relatively pleasing appearance, particularly when the paperboard blank 200 is printed.

All of the fold lines, i.e. first vertical fold line 210, second vertical fold line 220, third vertical fold line 230, fourth vertical fold line 240, horizontal fold lines H1*a*, H1*b*, H2*b*, H3*b*, H4*b*, 61*a* and 72*a* are formed by crushing the paperboard material along the line to be folded to facilitate bending of the paperboard material to form the various panels and flaps.

To assemble carton 100, blank 200 is first folded by bending the paperboard material along first vertical fold line 210, second vertical fold line 220, third vertical fold line 230 and fourth vertical fold line 240 so that each of the adjacent panels, i.e. adhesive tab 10, first side panel 20, bottom panel 30, second side panel 40, and top panel 50 are generally perpendicular to each other. This will put adhesive tab 10 adjacent to top panel 50 so that first vertical fold line 210 can be aligned with the right edge 59 of top panel 50. When in this position, adhesive tab 10 can be glued, stapled or otherwise adhered by conventional means to top panel 50 to form a box configuration that is open on both the top and bottom. As shown in the Figs., adhesive tab 10 has a left edge 15 which includes two arcuate portions 15*a*. These arcuate portions have a radius of curvature that is substantially similar to or greater than the radius of curvature of perforations 55. This arrangement allows more of the material of adhesive tab 10 to overlap top panel 10 without covering perforations 55.

Thereafter, first corner panel 60 is folded about horizontal perforation line 45 so its left edge is aligned with inclined edge 33 and its right edge is aligned with inclined edge 53. Next, first side panel top flap 21 is folded about horizontal fold line H1*a*, bottom panel top flap 31 is folded about horizontal perforation line H2*a*, first corner panel top flap 61 is folded about horizontal fold line 61*a*, and bottom panel top flap 51 is folded about horizontal fold line H3*c*. Each of first side panel top flap 21, bottom panel top flap 31, first corner panel top flap 61 and bottom panel top flap 51 are folded inward toward the interior of the resulting carton 100 so they can be glued, stapled or otherwise adhered to each other by standard fastening means to close one end of carton 100. The other end of carton 100 is formed in a similar manner. Second corner panel 70 is folded about horizontal fold line H4*b* so its left edge is aligned with inclined edge 34 and its right edge is aligned with inclined edge 54. Next, first side panel bottom flap 22 is folded about horizontal fold line H1*b*, bottom panel bottom flap 32 is folded about horizontal fold line H2*b*, second corner panel bottom flap 72 is folded about horizontal fold line 72*a*, and bottom panel bottom flap 52 is folded about horizontal fold line H3*b*. Each of first side panel bottom flap 22, bottom panel bottom flap 32, second corner panel bottom flap 72 and bottom panel bottom flap 52 are folded inward toward the interior of the resulting carton 100 so they can be glued, stapled or otherwise adhered to each other by standard fastening means to close the other end of carton 100.

As noted above, first side panel top flap 21, bottom panel top flap 31, first corner side panel top flap 61 and top panel top flap 51 are adhered together and the upper portion of first side panel 20 and first side panel top flap 21 are connected to the rest of first side panel 20 by perforation 25, bottom panel top flap 31 is connected to bottom panel 30 by perforation line H2*a*, first corner panel 60 is connected to second side panel 40 by perforation 45 and top panel top flap 51 is connected to top panel 50 by perforation H3*a*. Thus, this end of carton 100 can be easily removed along all of these perforation lines to form opening 110 even though first side panel top flap 21, bottom panel top flap 31, first corner panel top flap 61 and top panel top flap 51 are adhered together.

The present invention has been described with reference to exemplary embodiments thereof. It will be readily apparent, however, to those skilled in the art that it is possible to embody the invention in specific forms other than those of the exemplary embodiments described above. This may be done without departing from the spirit of the invention. The exemplary embodiments are merely illustrative and should not be considered restrictive in any way.

I claim:

1. A carton, comprising:

a top:

a bottom spaced from the top:

a first side wall interconnecting the top and the bottom;

a second side wall generally parallel to and spaced from the first side wall and interconnecting the top and the bottom;

a first end wall adjoining the top and the bottom;

a second end wall generally parallel to and spaced from the first end wall and adjoining the top and the bottom and wherein the second end wall is removably interconnected to the second side wall by a perforation line;

a first corner panel adjoining the first end wall, the first side wall, the top and the bottom, the first corner panel comprising a first edge disposed in direct contact with an edge of the first end wall, a second edge disposed in direct contact with an edge of the first side wall, a third edge disposed in direct contact with an edge of the top, and a fourth edge disposed in direct contact with an edge of the bottom; and a second corner panel adjoining the second end wall, the first side wall, the top and the bottom and wherein the second corner panel is removably interconnected to the top, the bottom and the first side wall.

2. The carton of claim 1 wherein the perforation line interconnecting the second end wall to the second side wall has an arcuate shape.

3. The carton of claim 1 wherein the first side wall has a first cross sectional area and the second side wall has a second cross sectional area such that the first cross sectional area is less than the second cross sectional area.

4. The carton of claim 3 wherein the first side wall has a first width and the second side wall has a second width such that the first width is less than the second width.

5. The carton of claim 1 wherein the first corner panel adjoins the first end wall at an obtuse included angle.

6. The carton of claim 5 wherein the second corner panel adjoins the second end wall at an obtuse included angle.

7. The carton of claim 1, wherein:

the second corner panel comprises a first edge disposed in direct contact with an edge of the second end wall, a second edge disposed in direct contact with an edge of the first side wall, a third edge disposed in direct contact with an edge of the top, and a fourth edge disposed in direct contact with an edge of the bottom.

8. A blank, comprising:

an adhesive tab;

a first side panel connected to the adhesive tab along a first fold line;

a bottom panel connected to the first side panel along a second fold line;

a second side panel connected to the bottom panel along a third fold line;

a top panel connected to the second side panel along a fourth fold line;

a first side panel top flap extending above the first side panel above a fifth fold line;

a first side panel bottom flap extending below the first side panel below a sixth fold line;

a bottom panel top flap extending above the bottom panel above a first perforation line;

a bottom panel bottom flap extending below the bottom panel below a seventh fold line;

a first corner panel extending above the second side panel above a second perforation line;

a first corner panel top flap extending above the first corner panel above an eighth fold line, wherein the first corner panel comprises a first edge disposed in direct contact with an edge of the second side panel, and a second edge disposed in direct contact with an edge of the first corner panel top flap;

a second corner panel extending below the second side panel below a ninth fold line;

a second corner panel bottom flap extending below the second corner panel below a tenth fold line;

a top panel top flap extending above the top panel above a third perforation line; and a top panel bottom flap extending below the top panel below an eleventh fold line.

9. The blank of claim 8 wherein the first side panel and the second side panel each has a generally rectangular cross section.

10. The blank of claim 9 wherein the cross sectional area of the first side panel is greater than the cross sectional area of the second side panel.

11. The blank of claim 10 wherein the lengths of the first fold line and the second fold line are greater than the lengths of third fold line and the fourth fold line.

12. The blank of claim 8 further including a fourth perforation formed in the upper portion of the first side panel extending from the first fold line adjacent to the fifth fold line to the second fold line adjacent to the fifth fold line.

13. The blank of claim 12 wherein the fourth perforation has an arcuate shape.

14. A carton, comprising:

a top:

a bottom spaced from the top:

a first side wall interconnecting the top and the bottom;

a second side wall generally parallel to and spaced from the first side wall and interconnecting the top and the bottom;

a first end wall adjoining the top and the bottom;

a second end wall generally parallel to and spaced from the first end wall and adjoining the top and the bottom and wherein the second end wall is removably interconnected to the second side wall by a perforation line;

a first corner panel adjoining the first end wall, the first side wall, the top and the bottom;

a second corner panel adjoining the second end wall, the first side wall, the top and the bottom and wherein the second corner panel is removably interconnected to the top, the bottom and the first side wall; and wherein the carton is formed from a blank having an adhesive tab; a first side panel connected to the adhesive tab along a first fold line; a bottom panel connected to the first side panel along a second fold line; a second side panel connected to the bottom panel along a third fold line; a top panel connected to the second side panel along a fourth fold line; a first side panel top flap extending above the first side panel above a fifth fold line; a first side panel bottom flap extending below the first side panel below a sixth fold line; a bottom panel top flap extending above the bottom panel above a first perforation line; a bottom panel bottom flap extending below the bottom panel below a seventh fold line; a first corner panel extending above the second side panel above a second perforation line; a first corner panel top flap extending above the first corner panel above an eighth fold line, wherein the first corner panel comprises a first edge disposed in direct contact with an edge of the second side panel, and a second edge disposed in direct contact with an edge of the first corner panel top flap; a second corner panel extending below the second side panel below a ninth fold line; a second corner panel bottom flap extending below the second corner panel below a tenth fold line; a top panel top flap extending above the top panel above a third perforation line; and a top panel bottom flap extending below the top panel below an eleventh fold line.

15. The carton of claim 14 wherein the first side wall has a first cross sectional area and the second side wall has a second cross sectional area such that the first cross sectional area is less than the second cross sectional area.

16. The carton of claim 15 wherein the first side wall has a first width and the second side wall has a second width such that the first width is less than the second width.

17. The carton of claim 14 wherein the first corner panel adjoins the first end wall at an obtuse included angle.

18. The carton of claim 17 wherein the second corner panel adjoins the second end wall at an obtuse included angle.

19. The carton of claim 14 further including a fourth perforation formed in the upper portion of the first side panel extending from the first fold line adjacent to the fifth fold line to the second fold line adjacent to the fifth fold line.

20. The blank of claim 19 wherein the fourth perforation has an arcuate shape.

* * * * *